US005492785A

United States Patent [19]

Normandin et al.

[11] Patent Number: 5,492,785

[45] Date of Patent: Feb. 20, 1996

[54] MULTILAYERED PHOTORECEPTOR

[75] Inventors: Sharon E. Normandin, Macedon; Donald P. Sullivan, Rochester; Alfred H. Willnow, Ontario; Kathleen M. Carmichael, Williamson; Karl V. Thomsen, Ontario; John A. Bergfjord, Macedon, all of N.Y.

[73] Assignee: Xerox Corporation, Stamford, Conn.

[21] Appl. No.: 368,117

[22] Filed: Jan. 3, 1995

[51] Int. Cl.[6] ..... G03G 5/047; G03G 5/14; G03G 5/10

[52] U.S. Cl. ..... 430/58; 430/59; 430/63; 430/64; 430/69

[58] Field of Search ..... 430/58, 59, 63, 430/64, 69

[56] References Cited

U.S. PATENT DOCUMENTS

| | | | |
|---|---|---|---|
| 3,997,342 | 12/1976 | Bailey . | |
| 4,025,341 | 5/1977 | Rule . | |
| 4,265,990 | 5/1981 | Stolka et al. | 430/59 |
| 4,464,450 | 8/1984 | Teuscher | 430/59 |
| 4,587,189 | 5/1986 | Hor et al. | 430/59 |
| 4,588,667 | 5/1986 | Jones et al. | 430/73 |
| 4,780,385 | 10/1988 | Wieloch et al. | 430/58 |
| 4,786,570 | 11/1988 | Yu et al. | 430/58 |
| 4,943,508 | 7/1990 | Yu | 430/129 |
| 5,019,473 | 5/1991 | Nguyen et al. | 430/58 |
| 5,357,320 | 10/1994 | Kashimura et al. | 430/66 X |

*Primary Examiner*—Roland Martin

[57] ABSTRACT

An electrophotographic imaging member is disclosed having an imaging surface adapted to accept a negative electrical charge, the electrophotographic imaging member comprising a metal ground plane layer comprising at least 50 percent by weight zirconium, a siloxane hole blocking layer, an adhesive layer comprising a polyacrylate film forming resin, a charge generation layer comprising benzimidazole perylene particles dispersed in a film forming resin binder of poly(4,4'-diphenyl-1,1'-cyclohexane carbonate), and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

5 Claims, No Drawings

MULTILAYERED PHOTORECEPTOR

BACKGROUND OF THE INVENTION

This invention relates in general to electrophotography and more specifically, to an improved electrophotographic imaging member and process for using the imaging member.

In the art of electrophotography an electrophotographic plate comprising a photoconductive insulating layer on a conductive layer is imaged by first uniformly electrostatically charging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

As more advanced, higher speed electrophotographic copiers, duplicators and printers were developed, degradation of image quality was encountered during extended cycling. Moreover, complex, highly sophisticated, duplicating and printing systems operating at very high speeds have placed stringent requirements including narrow operating limits on photoreceptors. For example, the layers of many modern photoconductive imaging members must be highly flexible, adhere well to each other, and exhibit predictable electrical characteristics within narrow operating limits to provide excellent toner images over many thousands of cycles.

One type of popular belt type photoreceptors comprises a vacuum deposited aluminum coated with two electrically operative layers, including a charge generating layer and a charge transport layer. However, aluminum films are relatively soft and exhibit poor scratch resistance during photoreceptor fabrication processing. In addition, vacuum deposited aluminum exhibits poor optical transmission stability after extended cycling in xerographic imaging systems. This poor optical transmission stability is the result of oxidation of the aluminum ground plane as electric current is passed across the junction between the metal and photoreceptor. The optical transmission degradation is continuous and, for systems utilizing erase lamps on the nonimaging side of the photoconductive web, has necessitated erase intensity adjustment every 20,000 copies over the life of the photoreceptor.

Further, the electrical cyclic stability of an aluminum ground plane in multilayer structured photoreceptors has been found to be unstable when cycled thousands of times. The oxides of aluminum which naturally form on the aluminum metal employed as an electrical blocking layer prevent charge injection during charging of the photoconductive device. If the resistivity of this blocking layer becomes too great, a residual potential will build across the layer as the device is cycled. Since the thickness of the oxide layer on an aluminum ground plane is not stable, the electrical performance characteristics of a composite photoreceptor undergoes changes during electrophotographic cycling. Also, the storage life of many composite photoreceptors utilizing an aluminum ground plane can be as brief as one day at high temperatures and humidity due to accelerated oxidation of the metal. The accelerated oxidation of the metal ground plane increases optical transmission, causes copy quality nonuniformity and can ultimately result in loss of electrical grounding capability.

After long-term use in an electrophotographic copying machine, multilayered photoreceptors utilizing the aluminum ground plane have been observed to exhibit a dramatic dark development potential change between the first cycle and second cycle of the machine due to cyclic instability, referred to as "cycle 1 to 2 dark development potential variation". The magnitude of this effects is dependent upon cyclic age and relatively humidity but may be as large as 350 volts after 50,000 electrical cycles. This effect is related to interaction of the ground plane and photoconductive materials. Another serious effect of the aluminum ground plane is the loss of image potential with cycling at low relative humidity. This cycle down voltage is most severe at relative humidities below about 10 percent. With continued cycling, the image potential decreases to a degree where the photoreceptor cannot provide a satisfactory image in the low humidity atmosphere.

In some multilayered photoreceptors, the ground plane is titanium coated on a polyester film. The titanium coating is sputtered on the polyester film in a layer about 175 angstroms thick. The titanium layer acts as a conductive path for electrons during the exposure step in the photoconductive process and overcomes many of the problems presented by aluminum ground planes. Photoreceptors containing titanium ground planes are described, for example, in U.S. Pat. No. 4,588,667 to Jones et al. The entire disclosure of this patent is incorporated herein by reference. Although excellent toner images may be obtained with multilayered photoreceptors having a titanium ground plane, it has been found that charge deficient spots form in photoreceptors containing titanium ground planes, particularly under the high electrical fields employed in high speed electrophotographic copiers, duplicators and printers. Moreover, the growth rate in number and size of newly created charge deficient spots and growth rate in size of preexisting charge deficient spots for photoreceptors containing titanium ground planes are unpredictable from one batch to the next under what appear to be controlled, substantially identical fabrication conditions. Charge deficient spots are small unexposed areas on a photoreceptor that fail to retain an electrostatic charge. These charge deficient spots become visible to the naked eye after development with toner material. On copies prepared by depositing black toner material on white paper, the spots may be white or black depending upon whether a positive or reversal image development process is employed. In positive image development, charge deficient spots appear as white spots in the solid image areas of the final xerographic print. In other words, the image areas on the photoreceptor corresponding to the white spot fails to attract toner particles in positive right reading image development. In reversal image development, black spots appear in background areas of the final xerographic copy. Thus, for black spots to form, the charge deficient spots residing in background areas on the photoreceptor attract toner particles during reversal image development. The white spots and black spots always appear in the same location of the final electrophotographic copies during cycling of the photoreceptor. The white spots and black spots do not exhibit any single characteristic shape, are small in size, and are visible to the naked eye. Generally, these visible spots caused by charge deficient spots have an average size of less than about 200 micrometers. These spots grow in size and total number during xerographic cycling and become more objectionable with cycling. Thus, for example tiny spots that are barely visible to the naked eye can grow to a size of about 150 micrometers. Other spots may be as large as 150 micrometers with fresh photoreceptors. Visual examination of the areas on the surface of the photoreceptor which correspond to the location of white spots and black spots reveals no differences in appearance from other acceptable areas of the photoreceptor. There is no known test to detect a charge deficient spot other than by forming a toner image to detect the defect.

Many of the deficiencies of the aluminum and titanium ground planes have been overcome by the use of metal ground plane layer comprising zirconium. This type of ground plane is described in detail in U.S. Pat. No. 4,780,385, the entire disclosure thereof being incorporated herein by reference. The metal ground plane layer comprising zirconium described in U.S. Pat. No. 4,780,385 may be utilized with various charge blocking layers, adhesive layers, charge generating layers and charge transport layers for example, the charge blocking layer may comprise polyvinylbutyral; organosilanes; epoxy resins; polyesters; polyamides; polyurethanes; pyroxyline vinylidene chloride resin; silicone resins; fluorocarbon resins and the like containing an organo metallic salt; and nitrogen containing siloxanes or nitrogen containing titanium compounds such as trimethoxysilyl propylene diamine, hydrolyzed trimethoxysilyl propyl ethylene diamine, N-beta(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino) titanate, isopropyl trianthranil titanate, isopropyl tri(N,N-dimethyl-ethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl)methyl diethoxysilane, and [H2N(CH2)3]CH3Si(OCH3)2 (gamma-aminopropyl)methyl dimethoxysilane, as disclosed in U.S. Pat. Nos. 4,291,110, 4,338,387, 4,286,033 and 4,291,110. A preferred blocking layer disclosed in U.S. Pat. No. 4,780,385 comprises a reaction product between a hydrolyzed silane and a zirconium oxide layer which inherently forms on the surface of the zirconium layer when exposed to air after deposition. This combination reduces spots at time 0 and provides electrical stability at low RH.

In some cases, an intermediate layer between the blocking layer and the adjacent generator layer may be used in the photoreceptor of U.S. Pat. No. 4,780,385 to improve adhesion or to act as an electrical barrier layer. Typical adhesive layers disclosed in U.S. Pat. No. 4,780,385 include film-forming polymers such as polyester, polyvinylbutyral, polyvinylpyrolidone, polyurethane, polycarbonates polymethylmethacrylate, mixtures thereof, and the like.

The photogenerating layer utilized in the photoreceptor disclosed in U.S. Pat. No. 4,780,385 include, for example, inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal free phthalocyanine, metal phthalocyanines such as vanadyl phthalocyanine and copper phthalocyanine, quinacidones available from DuPont under the tradename Monastral Red, Monastral violet and Monastral Red Y, Vat orange 1 and Vat Orange 3 trade names for dibromo anthanthrone pigments, benzimidazole perylene, substituted 2,4-diamino-triazines, polynuclear aromatic quinones available from Allied Chemical Corporation under the tradename indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189. Other suitable photogenerating materials known in the art may also be utilized, if desired. Charge generating binder layer comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred for the photoreceptor of U.S. Pat. No. 4,780,385 because of their sensitivity to white light.

Although excellent images may be obtained with the photoreceptor described in U.S. Pat. No. 4,780,385, it has also been found that for certain specific combinations of materials in the different layers, adhesion of the various layers under certain manufacturing conditions can fail and result in delamination of the layers during or after fabrication. Photoreceptor life can be shortened if the photoreceptor is extensively image cycled over small diameter rollers. Also, during extensive cycling, many belts exhibit undesirable dark decay and cycle down characteristics. The expression "dark decay" is defined as the loss of applied voltage from the photoreceptor in the absence of light exposure. "Cycle down", as utilized here and as defined as the increase in dark decay with increased charge/erase cycles of the photoreceptor.

A typical multi-layered photoreceptor exhibiting dark decay and cycle down under extensive cycling utilizes a charge generating layer containing trigonal selenium particles dispersed in a film-forming binder. It has also been found that multi-layered photoreceptors containing charge generating layers utilizing trigonal selenium particles are relatively insensitive to visible laser diode exposure systems.

Multi-layered photoreceptors containing charge generating layers comprising perylene pigments, particularly benzimidazole perylene, have been found to exhibit low dark decay compared to photoreceptors containing trigonal selenium in the charge generating layer. Moreover, photoreceptors containing perylene pigments in the charge generating layer exhibit a spectral sensitivity up to 720 nanometers and are, therefore, compatible with exposure systems utilizing visible laser diodes. However, some multi-layered photoreceptors containing perylene pigments in the charge generating layer have been found to form charge deficient spots. The expression "charge deficient spots" as employed herein is defined as localized area of dark decay.

Typically, flexible belts are fabricated by depositing the various layers of the photoreceptor as coatings onto long belts which are thereafter cut into sheets. The opposite ends of these sheets are welded together to form the belt. In order to increase throughput during the web coating operation, the webs to be coated have a width of twice the width of a vinyl belt. After coating, the web is slit lengthwise and thereafter transversely to form each sheet that is eventually welded into a belt. When multi-layered photoreceptors containing perylene pigments in the charge generating layer are slit lengthwise during the belt fabrication process, it has been found that some of the photoreceptor delaminates and becomes unusable. Delamination also prevents grinding of belt web seam to control seam thickness. All of these deficiencies hinder slitting of a web through the charge generating layer without encountering edge delamination or coating double wide charge generating layers to allow slitting into multiple narrower charge generating layers without encountering crossweb defects.

In general, photoconductive pigment loadings of 80 percent by volume are highly desirable in the photogenerating layer to provide excellent photosensitivity. These dispersions are highly unstable to extrusion coating conditions, resulting in numerous coating defects that generate a large number of unacceptable material that must be scrapped when using extrusion coating of a dispersion of pigment in organic solution of polymeric binder. More stable dispersions can be obtained by reducing the pigment loading to 30–40 percent by volume, but in most cases the resulting "diluted" photogenerating layer could not provide adequate photosensitivity. Also, the dispersions of higher pigment loadings generally provided a generator layer with poor to adequate adhesion to either the underlying ground plane or adhesive layer, or the overlying transport layer when polyvinylbutyral binders are utilized in the charge generating layer. Many of these organic dispersions are quite unstable with respect to pigment agglomeration, resulting in dispersion settling and the formation of dark streaks and spots of pigment during the coating process. Normally, the polymeric binders which produce the best (most stable, therefore most manufacturable) dispersion suffer from deficiencies either in xerographic or mechanical properties, while the least stable dispersions provided the best possible mechanical and xerographic properties. The best compromise of manufacturability and xerographical/mechanical performance is obtained by use of a photogenerating layer containing benzimide perylene pigment dispersed in bisphenol Z type polycarbonate film forming binder. However, when a polyester adhesive layer is employed in a photoreceptor in combination with a photogenerating layer containing benzimide perylene pigment dispersed in a bisphenol A type or bisphenol Z type polycarbonate film forming binder, adhesion between the generator layer and the adhesive layer can delaminate during certain slitting operations during fabrication or during extensive cycling over small diameter rollers.

In addition, when a multilayered belt imaging member containing benzimide perylene pigment dispersed in the bisphenol Z polycarbonate film forming binder in the charge generating layer is fabricated by welding opposite ends of a web together, delamination is encountered when attempts are made to grind away some of the weld splash material. Removal of the weld splash material allows the elimination of seams which form flaps that initially trap toner particles and thereafter release them as unwanted dirt. Also, the inability to grind, buff, or polish a welded seam causes reduced cleaning blade life and renders the seam incompatible with ultrasonic transfer subsystems.

Thus, there is a continuing need for improved photoreceptors that exhibit improved electrical properties and which are more resistant to delamination during slitting, grinding, buffing, polishing and image cycling.

INFORMATION DISCLOSURE STATEMENT

U.S. Pat. No. 4,780,385 to Wieloch et al., issued Oct. 25, 1988—An electrophotographic imaging member is disclosed having an imaging surface adapted to accept a negative electrical charge, the electrophotographic imaging member comprising a metal ground plane layer comprising zirconium, a hole blocking layer, a charge generation layer comprising photoconductive particles dispersed in a film forming resin binder, and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

U.S. Pat. No. 4,786,570 to Yu et al., issued Nov. 22, 1988—A flexible electrophotographic imaging member is disclosed which comprises a flexible substrate having an electrically conductive surface, a hole blocking layer comprising an aminosilane reaction product, an adhesive layer having a thickness between about 200 angstroms and about 900 angstroms consisting essentially of at least one copolyester resin having a specified formula derived from diacids selected from the group consisting of terephthalic acid, isophthalic acid, and mixtures thereof and a diol comprising ethylene glycol, the mole ratio of diacid to diol being 1:1, the number of repeating units equaling a number between about 175 and about 350 and having a $T_g$ of between about 50° C. to about 80° C., the aminosilane also being a reaction product of the amino group of the silane with the —COOH and —OH end groups of the copolyester resin, a charge generation layer comprising a film forming polymeric component, and a diamine hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer. Processes for fabricating and using the flexible electrophotographic imaging member are also disclosed.

U.S. Pat. No. 5,019,473 to Nguyen et al., issued May 28, 1991—An electrophotographic recording element is disclosed having a layer comprising a photoconductive perylene pigment, as a charge generation material, that is sufficiently finely and uniformly dispersed in a polymeric binder to provide the element with excellent electrophotographic speed. The perylene pigments are perylene-3,4,9, 10-tetracarboxylic acid imide derivatives.

U.S. Pat No. 4,587,189 to Hor et al., issued May 6, 1986—Disclosed is an improved layered photoresponsive imaging member comprised of a supporting substrate; a vacuum evaporated photogenerator layer comprised of a perylene pigment selected from the group consisting of a mixture of bisbenzimidazo(2,1-a-1',2'-b)anthra(2,1,9-def:6, 5,10-d'e'f')diisoquinoline- 6,11-dione, and bisbenzimidazo(2,1-a:2',1'-a)anthra(2,1,9-def:6,5,10-d'e'f')diisoquinoline-10,21-dione, and N,N'-diphenyl- 3,4,9, 10-perylenebis(dicarboximide); and an aryl amine hole transport layer comprised of molecules of a specified formula dispersed in a resinous binder.

U.S. Pat. No. 4,588,667 to Jones et al., issued May 13, 1986—An electrophotographic imaging member is disclosed comprising a substrate, a ground plane layer comprising a titanium metal layer contiguous to the substrate, a charge blocking layer contiguous to the titanium layer, a charge generating binder layer and a charge transport layer. This photoreceptor may be prepared by providing a substrate in a vacuum zone, sputtering a layer of titanium metal on the substrate in the absence of oxygen to deposit a titanium metal layer, applying a charge blocking layer, applying a charge generating binder layer and applying a charge charge transport layer. If desired, an adhesive layer may be interposed between the charge blocking layer and the photoconductive insulating layer.

U.S. Pat. No. 3,997,342 to Bailey, issued Dec. 14, 1976—A photoconductive element is disclosed having at least two layers, namely a charge-generation layer and a charge transport layer. The charge-generation layer contains a finely divided co-crystalline complex of (i) at least one polymer having an alkylidene diarylene group in a recurring unit and (ii) at least one pyrylium-type dye salt. The charge transport layer contains an organic photoconductive charge transport material exhibiting both kinetic and thermodynamic stability. Either one or both of the charge-generation and charge-transport layers of the element also contains a protonic acid material. The resultant photoconductive element exhibits persistent conductivity.

U.S. Pat. No. 4,025,341 to Rule, issued May 24, 1977—A photoconductive polymer, and photoconductive insulating compositions and elements containing the same, are disclosed. The aforementioned polymer is a condensation product, preferably of relatively low molecular weight, of certain tertiary aromatic amines and certain carbonyl-containing compounds.

U.S. Pat. No. 4,943,508 to Yu, issued Jul. 24, 1990—A process for fabricating an electrophotographic imaging member is disclosed which involves providing an electrically conductive layer, forming an aminosilane reaction product charge blocking layer on the electrically conductive layer, extruding a ribbon of a solution comprising an adhesive polymer dissolved in at least a first solvent on the electrically conductive layer to form a wet adhesive layer, drying the adhesive layer to form a dry continuous coating having a thickness between about 0.08 micrometer (800 angstroms) and about 0.3 micrometer (3,000 angstroms), applying to the dry continuous coating a mixture comprising charge generating particles dispersed in a solution of a binder polymer dissolved in at least a second solvent to form a wet generating layer, the binder polymer being miscible with the adhesive polymer, drying the wet generating layer to remove substantially all of the second solvent, and applying a charge transport layer, the adhesive polymer consisting essentially of a linear saturated copolyester reaction product of ethylene glycol and four diacids wherein the diol is ethylene glycol, the diacids are terephthalic acid, isophthalic acid, adipic acid and azelaic acid, the sole ratio of the terephthalic acid to the isophthalic acid to the adipic acid to the azelaic acid is between about 3.5 and about 4.5 for terephthalic acid; between about 3.5 and about 4.5 isophthalic acid; between about 0.5 and about 1.5 for adipic acid; between about 0.5 and about 1.5 for azelaic acid, the total moles of diacid being in a mole ratio of diacid to ethylene glycol in the copolyester of 1:1, and the $T_g$ of the copolyester resin being between about 32° C. about 50° C.

U.S. Pat. No. 4,464,450 to Teuscher, issued Aug. 7, 1984—An electrostatographic imaging member is disclosed having two electrically operative layers including a charge transport layer and a charge generating layer, the electrically operative layers overlying a siloxane film coated on a metal oxide layer of a metal conductive anode, said siloxane film comprising a reaction product of a hydrolyzed silane having a specified general formula.

U.S. Pat. No. 4,265,990 to Stolka et al., issued May 5, 1981—A photosensitive member is disclosed having at least two electrically operative layers is disclosed. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound having a specified general formula. This structure may be imaged in the conventional xerographic mode which usually includes charging, exposure to light and development.

SUMMARY OF THE INVENTION

It is, therefore, an object of the present invention to provide an improved photoreceptor member which overcomes the above-noted disadvantages.

It is yet another object of the present invention to provide an improved electrophotographic member having a ground plane which exhibits greater resistance to the formation of charge deficient spots during cycling.

It is a further object of the present invention to provide a photoconductive imaging member which enables successful slitting a wide web lengthwise through a charge generation layer comprising benzimidazole perylene and poly(4,4'-diphenyl-1,1'-cyclohexane carbonate).

It is still another object of the present invention to provide an electrophotographic imaging member having welded seams that can be buffed or ground without delaminating.

It is another object of the present invention to provide an electrophotographic imaging member which exhibits lower dark decay and improved cyclic stability, as well as having photoresponse to the visible laser diode.

The foregoing objects and others are accomplished in accordance with this invention by providing an electrophotographic imaging member comprising an electrophotographic imaging member having an imaging surface adapted to accept a negative electrical charge, the electrophotographic imaging member comprising a metal ground plane layer comprising at least 50 percent by weight of a material selected from the group consisting of zirconium, titanium and mixtures thereof, a siloxane hole blocking layer, an adhesive layer comprising a polyarylate film forming resin, a charge generation layer comprising benzimidazole perylene particles dispersed in a film forming resin binder of poly(4,4'-diphenyl-1,1'-cyclohexane carbonate), and a hole transport layer, the hole transport layer being substantially non-absorbing in the spectral region at which the charge generation layer generates and injects photogenerated holes but being capable of supporting the injection of photogenerated holes from the charge generation layer and transporting the holes through the charge transport layer.

The substrate may be opaque or substantially transparent and may comprise numerous suitable materials having the required mechanical properties. Accordingly, this substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like. Preferably, the substrate is in the form of an endless flexible belt and comprises a commercially available biaxially oriented polyester known as Mylar, available from E. I. du Pont de Nemours & Co. or Melinex available from ICI.

The thickness of the substrate layer depends on numerous factors, including economical considerations, and thus this layer for a flexible belt may be of substantial thickness, for example, over 200 micrometers, or of minimum thickness less than 50 micrometers, provided there are no adverse affects on the final photoconductive device. In one flexible belt embodiment, the thickness of this layer ranges from about 65 micrometers to about 150 micrometers, and preferably from about 75 micrometers to about 125 micrometers for optimum flexibility and minimum stretch when cycled around small diameter rollers, e.g. 12 millimeter diameter rollers.

The zirconium and/or titanium layer may be formed by any suitable coating technique, such as vacuum depositing technique. Typical vacuum depositing techniques include sputtering, magnetron sputtering, RF sputtering, and the like. Magnetron sputtering of zirconium or titanium onto a metallized substrate can be effected by a conventional type sputtering module under vacuum conditions in an inert atmosphere such as argon, neon, or nitrogen using a high purity zirconium or titanium target. The vacuum conditions are not particularly critical. In general, a continuous zirconium or titanium film can be attained on a suitable substrate, e.g. a polyester web substrate such as Mylar available from E. I. du Pont de Nemours & Co. with magnetron sputtering. It should be understood that vacuum deposition conditions may all be varied in order to obtain the desired zirconium or titanium thickness. Typical techniques for forming the zirconium and titanium layers are described in U.S. Pat. Nos. 4,780,385 and 4,588,667, the entire disclosures of which are incorporated herein in their entirety.

The conductive layer may comprise a plurality of metal layers with the outermost metal layer (i.e. the layer closest to the charge blocking layer) comprising at least 50 percent by weight of zirconium, titanium or mixtures thereof. At least 70 percent by weight of zirconium and/or titanium is preferred in the outermost metal layer for even better results. The multiple layers may, for example, all be vacuum deposited or a thin layer can be vacuum deposited over a thick layer prepared by a different techniques such as by casting. Thus, as an illustration, a zirconium metal layer may be formed in a separate apparatus than that used for previously depositing a titanium metal layer or multiple layers can be deposited in the same apparatus with suitable partitions between the chamber utilized for depositing the titanium layer and the chamber utilized for depositing zirconium layer. The titanium layer may be deposited immediately prior to the deposition of the zirconium metal layer. Generally, for rear erase exposure, a conductive layer light transparency of at least about 15 percent is desirable.

Regardless of the technique employed to form the zirconium and/or titanium layer, a thin layer of zirconium or titanium oxide forms on the outer surface of the metal upon exposure to air. Thus, when other layers overlying the zirconium layer are characterized as "contiguous" layers, it is intended that these overlying contiguous layers may, in fact, contact a thin zirconium or titanium oxide layer that has formed on the outer surface of the metal layer. If the zirconium and/or titanium layer is sufficiently thick to be self supporting, no additional underlying member is needed and the zirconium and/or titanium layer may function as both a substrate and a conductive ground plane layer. Ground planes comprising zirconium tend to continuously oxidize during xerographic cycling due to anodizing caused by the passage of electric currents, and the presence of this oxide layer tends to decrease the level of charge deficient spots with xerographic cycling. Generally, a zirconium layer thickness of at least about 100 angstroms is desirable to maintain optimum resistance to charge deficient spots during xerographic cycling. A typical electrical conductivity for conductive layers for electrophotgraphic imaging members in slow speed copiers is about $10^2$ to $10^3$ ohms/square.

After deposition of the zirconium an/or titanium metal layer, a hole blocking layer is applied thereto. Generally, electron blocking layers for positively charged photoreceptors allow holes from the imaging surface of the photoreceptor to migrate toward the conductive layer. Thus, an electron blocking layer is normally not expected to block holes in positively charged photoreceptors such as photoreceptors coated with charge generating layer and a hole transport layer. Any suitable hole blocking layer capable of forming an electronic barrier to holes between the adjacent photoconductive layer and the underlying zirconium and/or titanium layer may be utilized. The hole blocking layer is a nitrogen containing siloxanes such as trimethoxysilyl propylene diamine, hydrolyzed trimethoxysilyl propyl ethylene diamine, N-beta(aminoethyl) gamma-amino-propyl trimethoxy silane, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl dimethoxysilane. A preferred blocking layer comprises a reaction product between a hydrolyzed silane and the zirconium and/or titanium oxide layer which inherently forms on the surface of the metal layer when exposed to air after deposition. This combination reduces spots at time 0 and provides electrical stability at low RH. The imaging member is prepared by depositing on the zirconium and/or titanium oxide layer of a coating of an aqueous solution of the hydrolyzed silane at a pH between about 4 and about 10, drying the reaction product layer to form a siloxane film and applying electrically operative layers, such as a photogenerator layer and a hole transport layer, to the siloxane film.

The hydrolyzed silane may be prepared by hydrolyzing any suitable amino silane. Typical hydrolyzable silanes include 3-aminopropyl triethoxy silane, (N,N'-dimethyl 3-amino) propyl triethoxysilane, N,N-dimethylamino phenyl triethoxy silane, N-phenyl aminopropyl trimethoxy silane, trimethoxy silylpropyldiethylene triamine and mixtures thereof.

During hydrolysis of the amino silanes described above, the alkoxy groups are replaced with hydroxyl group.

After drying, the siloxane reaction product film formed from the hydrolyzed silane contains larger molecules. The reaction product of the hydrolyzed silane may be linear, partially crosslinked, a dimer, a trimer, and the like.

The hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product films may be achieved with solutions containing from about 0.1 percent by weight to about 5.0 percent by weight of the silane based on the total weight of the solution. A solution containing from about 0.05 percent by weight to about 0.2 percent by weight silane based on the total weight of solution are preferred for stable solutions which form uniform reaction product layers. It is important that the pH of the solution of hydrolyzed silane be carefully controlled to obtain optimum electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Some tolerable cycling-down has been observed with hydrolyzed amino silane solutions having a pH less than about 4.

Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorsilicic acid, Bromocresol Green, Bromophenol Blue, p-toluene sulfonic acid and the like.

Any suitable technique may be utilized to apply the hydrolyzed silane solution to the metal oxide layer of a metallic conductive anode layer. Typical application techniques include spraying, dip coating, roll coating, wire wound rod coating, and the like. Although it is preferred that the aqueous solution of hydrolyzed silane be prepared prior to application to the metal oxide layer, one may apply the silane directly to the metal oxide layer and hydrolyze the silane in situ by treating the deposited silane coating with water vapor to form a hydrolyzed silane solution on the surface of the metal oxide layer in the pH range described above. The water vapor may be in the form of steam or humid air. Generally, satisfactory results may be achieved when the reaction product of the hydrolyzed silane and metal oxide layer forms a layer having a thickness between about 20 Angstroms and about 2,000 Angstroms.

Drying or curing of the hydrolyzed silane upon the metal oxide layer should be conducted at a temperature greater than about room temperature to provide a reaction product layer having more uniform electrical properties, more complete conversion of the hydrolyzed silane to siloxanes and less unreacted silanol. Generally, a reaction temperature between about 100° C. and about 150° C. is preferred for maximum stabilization of electrochemical properties. The temperature selected depends to some extent on the specific metal oxide layer utilized and is limited by the temperature sensitivity of the substrate. The reaction temperature may be maintained by any suitable technique such as ovens, forced air ovens, radiant heat lamps, and the like.

The reaction time depends upon the reaction temperatures used. Thus less reaction time is required when higher reaction temperatures are employed. Satisfactory results have been achieved with reaction times between about 0.5 minute to about 45 minutes at elevated temperatures. For practical purposes, sufficient cross-linking is achieved by the time the reaction product layer is dry provided that the pH of the aqueous solution is maintained between about 4 and about 10.

One may readily determine whether sufficient condensation and cross-linking has occurred to form a siloxane reaction product film having stable electric chemical properties in a machine environment by merely washing the siloxane reaction product film with water, toluene, tetrahydrofuran, methylene chloride or cyclohexanone and examining the washed siloxane reaction product film to compare infrared absorption of Si-O-wavelength bands between about 1,000 to about 1,200 $cm^{-1}$. If the Si-O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer. This siloxane coating is described in U.S. Pat. No. 4,464,450 to L. A. Teuscher, the disclosure of thereof being incorporated herein in its entirety.

The siloxane blocking layer should be continuous and have a thickness of less than about 0.5 micrometer because greater thicknesses may lead to undesirably high residual voltage. A blocking layer of between about 0.005 micrometer and about 0.3 micrometer (50 Angstroms-3000 Angstroms) is preferred because charge neutralization after the exposure step is facilitated and optimum electrical performance is achieved. A thickness of between about 0.03 micrometer and about 0.06 micrometer is preferred for zirconium and/or titanium oxide layers for optimum electrical behavior and reduced charge deficient spot occurrence and growth. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like.

Any suitable polyarylate film forming thermoplastic ring compound may be utilized in the adhesive layer. Polyarylates are derived from aromatic dicarboxylic acids and diphenols and their preparation is well known. The preferred polyarylates are prepared from isophthalic or terephthalic acids and bisphenol A. In general, there are two processes that are widely used to prepare polyarylates. The first process involves reacting acid chlorides, such as isophthaloyl and terephthaloyl chlorides, with diphenols, such as bisphenol A, to yield polyarylates. The acid chlorides and diphenols can be treated with a stoichiometric amount of an acid acceptor, such as triethylamine or pyridine. Alternatively, an aqueous solution of the dialkali metal salt of the diphenols can be reacted with a solution of the acid chlorides in a water-insoluble solvent such as methylene chloride, or a solution of the diphenol and the acid chlorides can be contacted with solid calcium hydroxide with triethylamine serving as a phase transfer catalyst. The second process involves polymerization by a high-temperature melt or slurry process. For example, diphenyl isophthalate or terephthalate is reacted with bisphenol A in the presence of a transition metal catalyst at temperatures greater than 230° C. Since transesterification is a reversible process, phenol, which is a by-product, must be continually removed from the reaction vessel in order to continue polymerization and to produce high molecular weight polymers. Various processes for preparing polyarylates are disclosed in "Polyarylates," by Maresca and Robeson in Engineering Thermoplastics, James Margolis, ed., New York: Marcel Dekker, Inc. (1985), pages 255–259, which is incorporated herein by reference as well as the articles and patents disclosed therein which describe the various processes in greater detail.

A typical polyarylate has repeating units represented in the following formula:

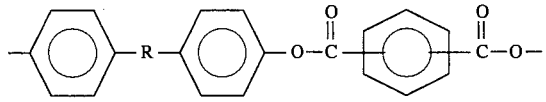

wherein R is $C_1$-$C_6$ alkylene, preferably $C_3$. These polyarylates have a weight average molecular weight greater than about 5,000 and preferably greater than about 30,000. The preferred polyarylate polymers have recurring units of the formula:

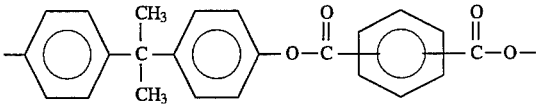

The phthalate moiety may be from isophthalic acid, terephthalic acid or a mixture of the two at any suitable ratios ranging from about 99 percent isophthalic acid and about 1 percent terephthalic acid to about 1 percent isophthalic acid and about 99 percent terephthalic acid, with a preferred mixture being between about 75 percent isophthalic acid and about 25 percent terephthalic acid and optimum results being achieved with between about 50 percent isophthalic acid and about 50 percent terephthalic acid. The polyarylates Ardel from Amoco and Durel from Celanese Chemical Company are preferred polymers. The most preferred polyarylate polymer is available from the Amoco Performance Products under the tradename Ardel D-100. Ardel is prepared from bisphenol-A and a mixture of 50 mol percent each of terephthalic and isophthalic acid chlorides by conventional methods. Ardel D-100 has a melt flow at 375° C. of 4.5 g/10 minutes, a density of 1.21 $Mg/m^3$, a refractive index of 1.61, a tensile strength at yield of 69 MPa, a thermal conductivity (k) of 0.18 W/m°K. and a volume resistivity of $3\times10^{16}$ ohm-cm. Durel is an amorphous homopolymer with a weight average molecular weight of about 20,000 to 200,000. Different polyarylates may be blended in the compositions of the invention.

The polyarylates may be dissolved in any suitable solvent. Both the Durel and Ardel polyarylates dissolve readily in THF, chlorobenzene, methylene chloride, chloroform, N-methylpyrrolidinone, N,N-dimethylformamide, N,N-dimethylacetamide, and the like.

Surprisingly, adhesive layers comprising the polyarylate provides markedly superior electrical and adhesive properties when it is employed in combination with a charge generating layer comprising benzimidazole perylene dispersed in a film forming resin binder of poly(4,4'-diphenyl-1,1'-cyclohexane carbonate) which enables slitting of a web without edge delamination and also allows grinding at a welded seam to control seam thickness. However, a polyarylate adhesive layer employed with a charge generating layer containing trigonal selenium particles dispersed in a film forming binder does not improve adhesion to a siloxane treated zirconium and/or titanium ground plane. Also unexpected, is the absence of markedly superior electrical and adhesive properties when other types of adhesive resins are used in the adhesive layer such as the polyester resin 49000 available from Morton. and the linear saturated copolyester reaction product of ethylene glycol with terephthalic acid, isophthalic acid, adipic acid and azelaic acid, Vitel PE-100, available from Goodyear Tire & Rubber Co.

The charge generating layer of the photoreceptor of this invention comprises a perylene pigment. The perylene pigment is preferably benzimidazole perylene which is also referred to as bis(benzimidazole). This pigment exists in the cis and trans forms. The cis form is also called bis-benzimidazo(2,1-a-1',1'-b)anthra(2,1,9-def:6,5,10-d'e'f')disoquinoline-6,11-dione. The trans form is also called bisbenzimidazo(2,1-a1',1'-b)anthra( 2,1,9-def:6,5,10-d'e'f')disoquinoline-10,21-dione. This pigment may be prepared by reacting perylene 3,4,9,10-tetracarboxylic acid dianhydride with 1,2-phenylene as illustrated in the following equation:

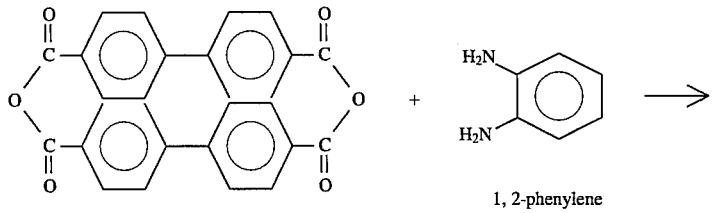

Perylene 3, 4, 9, 10-tetracarboxylic acid dianhydride 1, 2-phenylene

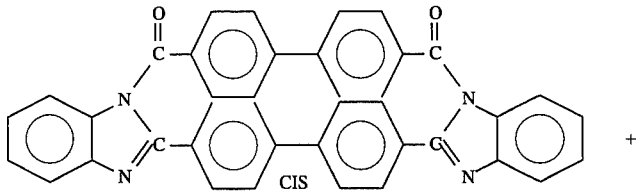

bisbenzimidazo(2, 1-a-1', 1'-b)anthra(2, 1, 9-def: 6, 5, 10-d'e'f')diisoquinoline-6, 11-dione -continued

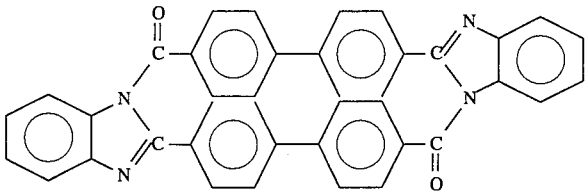

TRANS bisbenzimidazo(2, 1-a-1', 1'-b)anthra(2, 1, 9-def: 6, 5, 10-d'e'f')diisoquinoline-10, 21-dione Benzimidazole perylene is ground into fine particles having an average particle size of less than about 1 micrometer and dispersed in a preferred polycarbonate film forming binder of poly(4,4'-diphenyl-1,1'-cyclohexane carbonate). Optimum results are achieved with a pigment particle size between about 0.2 micrometer and about 0.3 micrometer. Benzimidazole perylene is described in U.S. Pat. Nos. 5,019,473 and 4,587,189, the entire disclosures thereof being incorporated herein by reference.

Poly(4,4'-diphenyl-1,1'-cyclohexane carbonate) has repeating units represented in the following formula:

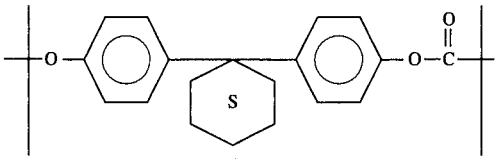

wherein "S" in the formula represents saturation.

The dispersions for charge generating layer may be formed by any suitable technique using, for example, attritors, ball mills, Dynomills, paintshakers, homogenizers, microfluidizers, and the like.

Electrical life is improved dramatically by the use of benzimidazole perylene dispersed in poly(4,4'-diphenyl-1,1'-cyclohexane carbonate). Preferably, the film forming polycarbonate binder for the charge generating layer has a molecular weight between about 20,000 and about 80,000. Satisfactory results may be achieved when the dried charge generating layer contains between about 20 percent and about 80 percent by volume benzimidazole perylene dispersed in poly(4,4'-diphenyl-1,1'-cyclohexane carbonate) based on the total volume of the dried charge generating layer. Preferably, the perylene pigment is present in an amount between about 30 percent and about 50 percent by volume. Optimum results are achieved with an amount between about 35 percent and about 45 percent by volume. Poly(4,4'-diphenyl-1,1'-cyclohexane carbonate) allow a reduction in perylene pigment loading without an extreme loss in photosensitivity.

Any suitable solvent may be utilized to dissolve the polycarbonate binder. Typical solvents include tetrahydrofuran, toluene, methylene chloride, and the like. Tetrahydrofuran is preferred because it has no discernible adverse effects on xerography and has an optimum boiling point to allow adequate drying of the generator layer during a typical slot coating process.

Satisfactory results may be achieved with a dry charge generating layer thickness between about 0.3 micrometer and about 3 micrometers. Preferably, the charge generating layer has a dried thickness of between about 1.1 micrometers and about 2 micrometers. The photogenerating layer thickness is related to binder content. Thicknesses outside these ranges can be selected providing the objectives of the present invention are achieved. Typical charge generating layer thicknesses give an optical density from about 1.7 and about 2.1.

Any suitable coating technique may be used to apply coatings. Typical coating techniques include slot coating, gravure coating, roll coating, spray coating, spring wound bar coating, dip coating, drawbar coating, reverse roll coating, and the like.

Any suitable drying technique may be utilized to solidify and dry the deposited coatings. Typical drying techniques include oven drying, forced air drying, infrared radiation drying, and the like.

Any suitable charge transport layer may be utilized. The active charge transport layer may comprise any suitable transparent organic polymer of non-polymeric material capable of supporting the injection of photogenerated holes and electrons from the charge generating layer and allowing the transport of these holes or electrons through the organic layer to selectively discharge the surface charge. The charge transport layer in conjunction with the generation layer in the instant invention is a material which is an insulator to the extent that an electrostatic charge placed on the transport layer is not conducted in the absence of illumination Thus, the active charge transport layer is a substantially non-photoconductive material which supports the injection of photogenerated holes from the generation layer.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

The charge transport layer forming mixture preferably comprises an aromatic amine compound. Typical aromatic amine compounds include triphenyl amines, bis and poly triarylamines, bis arylamine ethers, bis alkyl-arylamines and the like.

Examples of charge transporting aromatic amines for charge transport layers capable of supporting the injection of photogenerated holes of a charge generating layer and transporting the holes through the charge transport layer include, for example, triphenylmethane, bis(4-diethylamine-2-methylphenyl)phenylmethane; 4'-4"-bis(diethylamino)-2', 2"-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000.

The preferred electrically inactive resin materials are polycarbonate resins have a molecular weight from about 20,000 to about 120,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G. and a polycarbonate resin having a molecular weight of from about 20,000 to about 50,000 available as Merlon from Mobay Chemical Company.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used. A dried thickness of between about 18 micrometers and about 35 micrometers is preferred with optimum results being achieved with a thickness between about 24 micrometers and about 29 micrometers.

Preferably, the charge transport layer comprises an arylamine small molecule dissolved or molecularly dispersed in a polycarbonate.

Other layers such as conventional ground strips comprising, for example, conductive particles disposed in a film forming binder may be applied to one edge of the photoreceptor in contact with the zirconium and/or titanium layer, blocking layer, adhesive layer or charge generating layer.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

REVERSE PEEL TEST

The photoconductive imaging members of Control Examples I and Examples II, III, V (invention) were evaluated for adhesive properties using a 180° (reverse) peel test method.

The 180° peel strength is determined by cutting a minimum of five 0.5 inch×6 inches imaging member samples from each of Examples I and II, III, V. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape, 1.3 cm (½ inch) width Scotch Magic Tape #810, available from 3M Company At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer with the substrate by the width of the test sample. Results are in Table A and Table B.

MECHANICAL CYCLING TEST

A photoreceptor belt was fabricated from Example V. The edge of the belt was slit through the charge generation layer and cycled on a rig with straight cut LLF (low lateral force) rollers. The rig was adjusted so that the cut edge would ride against the edgeguide.

The results are as follows: After 100,000 cycles at room ambient temperature and % RH, no damage was observed on examination at the conclusion of this part of the test. After an additional 100,000 cycles at 30° C. and 80% RH, small cracks in the transport layer extending into the belt not more than 0.5 mm were seen and some delamination 1 mm into the belt and about 2"long was seen emanating from the cut edge; this delamination is due to extrinsic causes since it did not continue around the circumference of the belt. Normally, a typical photoreceptor containing 49000 polyester IFL (examples IV or VI) would delaminate greater than 5 mm within 15,000 cycles, enough to cause failure by catching and tearing the transport material.

ELECTRICAL SCANNING TEST

The electrical properties of the photoconductive imaging samples prepared according to Examples I, II were evaluated with a xerographic testing scanner comprising a cylindrical aluminum drum having a diameter of 24.26 cm (9.55 inches). The test samples were taped onto the drum. When rotated, the drum carrying the samples produced a constant surface speed of 76.3 cm (30 inches) per second. A direct current pin corotron, exposure light, erase light, and five electrometer probes were mounted around the periphery of the mounted photoreceptor samples. The sample charging time was 33 milliseconds. Both expose and erase lights were broad band white light (400–700 nm) outputs, each supplied by a 300 watt output Xenon arc lamp. The relative locations of the probes and lights are indicated in Table III below:

TABLE III

| Element | Angle (Degrees) | Position | Distance From Photoreceptor |
|---|---|---|---|
| Charge | 0 | 0 | 18 mm (Pins)<br>12 mm (Shield) |
| Probe 1 | 22.50 | 47.9mm | 3.17 mm |
| Expose | 56.25 | 118.8 | N.A. |
| Probe 2 | 78.75 | 166.8 | 3.17 mm |
| Probe 3 | 168.75 | 356.0 | 3.17 mm |
| Probe 4 | 236.25 | 489.0 | 3.17 mm |
| Erase | 258.75 | 548.0 | 125 mm |
| Probe 5 | 303.75 | 642.9 | 3.17 mm |

The test samples were first rested in the dark for at least 60 minutes to ensure achievement of equilibrium with the testing conditions at 40 percent relative humidity and 21° C. Each sample was then negatively charged in the dark to a development potential of about 900 volts. The charge acceptance of each sample and its residual potential after discharge by front erase exposure to 400 ergs/cm$^2$ were recorded. The test procedure was repeated to determine the photo induced discharge characteristic (PIDC) of each sample by different light energies of up to 20 ergs/cm$^2$. The 50,000 cycle electrical testing results obtained for the test samples of Examples IV, VI are collectively tabulated in Tables D. The photodischarge is given as the ergs/cm$^2$ needed to discharge the photoreceptor from a Vddp of 800 volts or 600 volts to 100 volts, QV intercept is an indicator of depletion charging.

CDS "BLACK SPOTS" TEST

The photoreceptor belt was then mounted in a xerographic copier for testing. The copier was a xerographic device which drove the photoreceptor belt at a constant speed of 7 inches per second. Charging devices, exposure lights, magnetic brush developer applicator and erase lights and probes were mounted around the periphery of the mounted photoreceptor belt. The photoreceptor was rested in the dark for 60 minutes prior to charging. It was then negatively corona charged in the dark to a development potential of −750 v. The photoreceptor was thereafter imagewise exposed to a test pattern using a light intensity of about 10 erg/cm$^2$ of light. The resulting negatively charged electrostatic latent image was developed with positively charged toner particles applied by a magnetic brush applicator. After electrostatic transfer of the deposited toner image to a paper copy sheet, the photoreceptor was discharged (erased) by exposure to about 500 erg/cm$^2$ of light. The toner images transferred to the copy sheets were fused by heated roll fusing. The photoreceptor was then subjected to the equivalent life of 150,000 imaging cycles. After initial copies were made at ambient room conditions (about 35 percent RH and 70° F.), the machine was then subjected to stress environmental conditions (10 percent RH, 70° F.). The machine was cycled without feeding paper. At the end of the test, the machine was returned to ambient room conditions. Paper was fed into the machine for imaging. The imaged copy sheets were scanned using electronic scanning with spot recognition. Each sheet was electronically compared to subsequent imaging cycles and a print rank was assigned using an algorithm based on numbers and sizes of spots; optimum rank value is 1.76, acceptable value is 2.75. Results are shown in Table C.

EXAMPLE I

A control photoconductive imaging member was prepared by providing a web of titanium coated polyester (Melinex, available from ICI Americas Inc.) substrate having a thickness of 3 mils, and applying thereto, with a gravure applicator, a solution containing 50 grams 3-amino-propyltriethoxysilane, 15 grams acetic acid, 684.8 grams of 200 proof denatured alcohol and 200 grams heptane. This layer was then dried for about 5 minutes at 135° C. in the forced air drier of the coater. The resulting blocking layer had a dry thickness of 500 Angstroms.

An adhesive interface layer was then prepared by the applying a wet coating over the blocking layer, using a gravure applicator, containing 3.5 percent by weight based on the total weight of the solution of copolyester adhesive (du Pont 49,000, available from E. I. du Pont de Nemours & Co.) in a 70:30 volume ratio mixture of tetrahydrofuran/cyclohexanone. The adhesive interface layer was then dried for about 5 minutes at 135° C. in the forced air drier of the coater. The resulting adhesive interface layer had a dry thickness of 620 Angstroms.

The adhesive interface layer was thereafter coated with a photogenerating layer (CGL) containing 30 percent by volume Benzimideazole Perylene and 70 percent by volume poly(4,4'-diphenyl-1,1'-cyclohexane carbonate. This photogenerating layer was prepared by introducing 0.3 grams PCZ -200 available from MItsubishi Gas Chem. and 48 ml of Tetrahydrofuran into a 4 oz. amber bottle. To this solution was added 1.6 gram of Benzimideazole Perylene and 300 grams of ⅛ inch diameter stainless steel shot. This mixture was then placed on a ball mill for 96 hours. 10 grams of the resulting dispersion was added to a solution containing 0.547 grams pf PCZ -200 and 6.14 grams of Tetrahydrofuran. The resulting slurry was thereafter applied to the adhesive interface with a Bird applicator to form a layer having a wet thickness of 0.5 mil. The layer was dried at 135° C. for 5 minutes in a forced air oven to form a dry thickness photogenerating layer having a thickness of 1.5 micrometers.

This photogenerator layer was overcoated with a charge transport layer. The charge transport layer was prepared by introducing into an amber glass bottle in a weight ratio of 1:1 N,N'-diphenyl-N,N'-bis(3-methylphenyl)- 1,1'-biphenyl-4,4'-diamine and Makrolon R, a polycarbonate resin having a molecular weight of from about 50,000 to 100,000 commercially available from Farbenfabriken Bayer A.G. The resulting mixture was dissolved in methylene chloride to form a solution containing 15 percent by weight solids. This solution was applied on the photogenerator layer using a Bird applicator to form a coating which upon drying had a thickness of 25 microns. During this coating process the humidity was equal to or less than 15 percent. The resulting photoreceptor device containing all of the above layers was annealed at 135° C. in a forced air oven for 5 minutes and thereafter cooled to ambient room temperature. Test samples tested for reverse peel strength gave typical reverse peel adhesion values of 3 to 15 g/cm. Normal peel tests conducted with the adhesive tape being peeled at 90 degrees rather than 180 degrees gave adhesion values of 50–200 g/cm.

EXAMPLE II

A photoreceptor was prepared as in Example I except that the polyarylate ARDEL D-100 (Amoco Performance Products) was substituted for the 49,000 as the adhesive interface layer.

EXAMPLE III

A photoreceptor was prepared as in Example I except that the charge generator layer was prepared as follows. A photogenerating layer (CGL) containing 40 percent by volume Benzimideazole Perylene and 60 percent by volume poly(4,4'-diphenyl-1,1'-cyclohexane)carbonate was prepared by introducing 52.1 pounds of a solution containing 20% by weight of PCZ-200 available from MItsubishi Gas Chem. in Tetrahydrofuran into a size 10S attritor with ⅛ inch diameter stainless steel shot. To this solution was added 2518 grams of Benzimideazole Perylene. This mixture was then attrited at 148 RPM for 24 hours. 28.3 pounds of the resulting dispersion was added to 8.2 pounds of a 20% by weight solution of PCZ-200 in Tetrahydrofuran. An additional 25.5 pounds of Tetrahydrofuran was then added. The resulting slurry was thereafter applied to the adhesive interface by slot coating. The layer was dried at 135° C. for 5 minutes in a forced air oven to form a dry thickness photogenerating layer having a thickness of 1.1 micrometers.

EXAMPLE IV

A photoreceptor was prepared as in Example III except that the layers were applied to a substrate web of titanium-zirconium coated polyester.

EXAMPLE V

A photoreceptor was prepared as in Example IV except that the polyarylate ARDEL D-100 (Amoco Performance Products) was substituted for the 49000 as the adhesive interface layer.

EXAMPLE VI

A photoreceptor was prepared as in Example IV except that the charge generator layer was comprised of 7.5% by volume t-selenium in polyvinylcarbazole having a thickness of 1.8 to 2.3 micrometers (1075 photoreceptor).

TABLE A

| | | ADHESION | ADHESION | Xerographic Properties | | |
|---|---|---|---|---|---|---|
| | Adhesive Layer | Reverse Peel g/cm | Normal Peel g/cm | E800–100 | Dark Decay V/Sec | $B_0$ QV Intercept |
| EXAMPLE I control | 49000 | 10.2 | 134 | 12.6 | −122 | −27 |
| EXAMPLE II invention | Ardel D-100 | 264.0 | Infinite | 12.4 | −171 | −113 |

TABLE B

| | ADHESION | ADHESION | XEROGRAPHICS | | |
|---|---|---|---|---|---|
| Adhesive Interface layer | reverse peel g/cm | normal peel g/cm | $E_{600-100}$ | DARK DECAY V/Sec | QV INTERCEPT $B_0$ |
| Example III 49000 IFL CONTROL | 6.3 | 128.4 | 5.8 | −88 | −93 |
| Example V ARDEL IFL INVENTION | 131.1 | INFINITE (BROKE) | 5.2 | −109 | −202 |

TABLE C

| substrate | CDS Rank @ Cycle # | | | |
|---|---|---|---|---|
| metallization | t = 0 | 50K | 75K | 125K |
| Example III | 5.1 | 13.3 | | |

TABLE C-continued

| substrate | CDS Rank @ Cycle # | | | |
|---|---|---|---|---|
| metallization | t = 0 | 50K | 75K | 125K |
| Ti control | | | | |
| Example IV Ti/Zr | 10.76 | 4.65 | 3.81 | 2.26 |

TABLE D

| Generator layer | Xerographic Properties t = 0 | | | Xerographic Properties t = 50K | | |
|---|---|---|---|---|---|---|
| | $E_{600-100}$ | Dark Decay V/sec | QV Intercept | $E_{600-100}$ | Dark Decay V/sec | QV Intercept |
| Example VI control | 6.1 | −231 | −127 | 6.64 | −532 | −209 |
| Example IV invention | 6.43 | −97 | −125 | 6.39 | −105 | −307 |

Table A shows that adhesion for 30 percent benzimidazole perylene in poly(4,4'-diphenyl-1,1'-cyclohexane carbonate) binder increases two hundred fold, with little effect on xerographic properties. Table B shows the same effect for adhesion for 40 percent benzimidazole perylene in poly(4,4'-diphenyl-1,1' -cyclohexane carbonate) binder.

Table C shows the improvement in print quality with machine cycling age with titanium-zirconium metallized substrate, using titanized substrate as a control. Table D shows the improvement in dark decay and long term cyclic stability with benzimidazole/polycarbonate generating layer using a XEROX 1075 photoreceptor as a control.

While the embodiment disclosed herein is preferred, it will be appreciated from this teaching that various alternative, modifications, variations or improvements therein may be made by those skilled in the art, which are intended to be encompassed by the following claims:

What is claimed is:

1. An electrophotographic imaging member having an imaging surface adapted to accept a negative electrical charge, said electrophotographic imaging member comprising a metal ground plane layer comprising at least 50 percent by weight zirconium, a siloxane hole blocking layer, an adhesive layer comprising a polyarylate film forming resin, a charge generation layer comprising benzimidazole perylene particles dispersed in a film forming resin binder of poly(4,4'-diphenyl-1,1'-cyclohexane carbonate), and a hole transport layer, said hole transport layer being substantially non-absorbing in the spectral region at which the charge generation layer generates and injects photogenerated holes but being capable of supporting the injection of photogenerated holes from said charge generation layer and transporting said holes through said charge transport layer.

2. An electrophotographic imaging member according to claim 1 wherein said polyarylate film forming resin has the following repeating structural units:

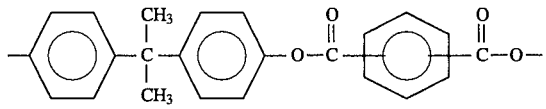

3. An electrophotographic imaging member according to claim 1 wherein said metal ground plane layer comprises a zirconium layer overlying a titanium layer.

4. An electrophotographic imaging member according to claim 3 wherein said zirconium layer has a thickness of at least about 60 Angstrom units.

5. An electrophotographic imaging member according to claim 1 wherein said blocking layer comprises an aminosiloxane.

* * * * *